US008806725B2

(12) United States Patent
Keyaki et al.

(10) Patent No.: US 8,806,725 B2
(45) Date of Patent: Aug. 19, 2014

(54) SLIDE FASTENER

(75) Inventors: Keiichi Keyaki, Toyama (JP); Takanori Ozawa, Toyama (JP)

(73) Assignee: YKK Corporation (JP)

( * ) Notice: Subject to any disclaimer, the term of this patent is extended or adjusted under 35 U.S.C. 154(b) by 433 days.

(21) Appl. No.: 13/387,749

(22) PCT Filed: Jul. 29, 2009

(86) PCT No.: PCT/JP2009/063479
§ 371 (c)(1),
(2), (4) Date: Jan. 30, 2012

(87) PCT Pub. No.: WO2011/013210
PCT Pub. Date: Feb. 3, 2011

(65) Prior Publication Data

US 2012/0124787 A1 May 24, 2012

(51) Int. Cl.
*A44B 19/38* (2006.01)
*A44B 19/26* (2006.01)

(52) U.S. Cl.
CPC ..... *A44B 19/382* (2013.01)
USPC ..... 24/433; 24/427

(58) Field of Classification Search
CPC ..... A44B 19/382; A44B 19/38; A44B 19/26
USPC ..... 24/433, 434, 427, 436
See application file for complete search history.

(56) References Cited

U.S. PATENT DOCUMENTS 4,152,813 A 5/1979 Heimberger
6,195,852 B1 3/2001 Kusayama
6,615,458 B2 * 9/2003 Takasawa et al. ..... 24/433
7,690,089 B2 4/2010 Keyaki et al.
2002/0050031 A1 5/2002 Takasawa et al.
2005/0193528 A1 9/2005 Hamada
2005/0278904 A1 12/2005 Matsumoto et al.
2006/0282998 A1 12/2006 Kusayama et al.
2008/0092347 A1 4/2008 Ogura
2009/0094805 A1 4/2009 Keyaki et al.

FOREIGN PATENT DOCUMENTS

JP 6373013 5/1988
JP 2000-106917 A1 4/2000
JP 2009-95425 A1 5/2009

OTHER PUBLICATIONS

International Search Report, PCT Application No. PCT/JP09/063479, mailed Nov. 10, 2009.

* cited by examiner

*Primary Examiner* — Robert J Sandy
(74) *Attorney, Agent, or Firm* — Kilpatrick Townsend & Stockton LLP

(57) ABSTRACT

A slide fastener according to the invention includes a left-and-right pair of first and second fastener stringers, a box pin provided on the first fastener stringer, an insert pin provided on the second fastener stringer, and a pair of first and second sliders. The box pin has a box pin body, a stopper portion, and a ridge portion formed on the box pin body. Further, a chamfered portion is formed on an inner surface of at least one of the upper and lower wing plates of the first slider. The ridge portion is arranged at a position in close contact with the chamfered portion of the first slider when the first slider is stopped at the stopper portion. With this arrangement, it becomes possible to cause the user to be accustomed to securely slide the first slider to the normal insert-pin inserting position.

4 Claims, 11 Drawing Sheets

SLIDE FASTENER

This application is a national stage application of PCT/JP2009/063479, which is incorporated herein by reference.

TECHNICAL FIELD

The invention relates to a slide fastener capable of performing an open/insert operation by having an insert pin provided on one fastener stringer, a box pin provided on the other fastener stringer, and a pair of upper and lower sliders having rear openings arranged opposite to each other.

BACKGROUND ART

Conventionally, to open and close left and right front parts of clothes, a slide fastener including a separable bottom end stop is used in many cases. For example, as a slide fastener mainly used for a long coat and a ski wear, for example, there is known a slide fastener capable of separating left and right rows of elements in an engaged state from not only one end (an upper end) of a fastener chain but also from the other end (a lower end) of the fastener chain, to increase functionability and designability of clothes. The slide fastener capable of separating the rows of elements in the engaged state from both ends is also called a reverse-opening slide fastener.

An example of the reverse-opening slide fastener is disclosed in Japanese Patent Application Laid-Open No. 2009-95425 (Patent Document 1).

As shown in FIGS. 15 and 16, a slide fastener 101 described in Patent Document 1 includes a pair of left and right fastener stringers 102 having rows 103 of elements, a box pin 104 arranged on the right fastener stringer 102, an insert pin 105 arranged on the left fastener stringer 102, and a first slider (a lower slider) 106*a* and a second slider (an upper slider) 106*b* slidably arranged along the rows 103 of elements.

Each of the left and right fastener stringers 102 include fastener tapes 107 having core thread portions 107*a* at opposite tape-side edges, and the rows 103 of elements formed by having a plurality of fastener elements attached to tape-side edge portions (element attachment portions) of the fastener tapes 107 including the core thread portions 107*a*. Stoppers 108 that prevent detachment of the second slider 106*b* are arranged at front ends of the left and right rows 103 of elements.

The box pin 104 is continuously extended from a rear end of the row 103 of elements arranged on the right fastener stringer 102. The box pin 104 includes a box pin body 111 that is fixed to a tape-end edge portion of the right fastener tape 107 including the core thread portion 107*a*, a stopper portion 112 that is arranged at a rear end portion of the box pin body 111 and stops the first slider 106*a* to prevent detachment of the first slider 106*a*, a first locking piece 113 having a triangular shape that is projected from the opposite surface of the insert pin 105 of the box pin body 111, and suppressing portions 114 that is formed on a front surface and a back surface of the base end portion at the row of elements side in the box pin body 111 and suppress sliding of the second slider 106*b*.

According to the slide fastener 101 in Patent Document 1, the suppressing portions 114 are formed on a front surface and a back surface of the box pin body 111, as described above. Therefore, when the first slider 106*a* and the second slider 106*b* are lowered to an end position at a box pin 104 side along the rows 103 of elements and are held by the box pin 104, the suppressing portions 114 of the box pin 104 are brought into close contact with an inner surface of a slider body of the second slider 106*b*, and increase frictional force of the second slider 106*b* to the box pin 104.

Therefore, a relative position of the second slider 106*b* is stabilized, and free sliding of the second slider 106*b* is suppressed. Effects as explained below are obtained by this configuration.

For example, when the slide fastener 101 that can be reversely opened is used for a long coat or the like, the insert pin 105 and the box pin 104 of the slide fastener 101 are generally arranged at a position of a lower end portion of the front of the long coat. Therefore, when a person who wears the long coat closes the left and right fastener stringers 102, the person first lowers the first and second sliders 106*a*, 106*b* to an end position where the box pin 104 is arranged along the rows 103 of elements. Thereafter, the person inserts the insert pin 105 into an element guiding path of the first and second sliders 106*a*, 106*b*.

At this time, the person reverses directions of the first and second sliders 106*a*, 106*b* by folding back a coattail of the long coat upward, to facilitate operation of inserting the insert pin 105 into the first and second sliders 106*a*, 106*b*. Further, the insert pin 105 is often inserted into the first and second sliders 106*a*, 106*b* in a state that the first and second sliders 106*a*, 106*b* are lifted to a position where the insert operation of the insert pin 105 becomes easy. In this case, a positional relationship of the first and second sliders 106*a*, 106*b* is reversed. Therefore, the insert pin 105 is inserted from lower sides of the first and second sliders 106*a*, 106*b*.

However, when the box pin 104 and the first and second sliders 106*a*, 106*b* are lifted to a position where the insert operation of the insert pin 105 becomes easy as described above, the first slider 106*a* and the second slider 106*b* move downward due to own weight from a box-pin-side end position where the inert pin 105 can be inserted (hereinafter, "insert-pin inserting position") and are deviated, when the first slider 106*a* and the second slider 106*b* are not supported with fingers.

When positions of the first and second sliders 106*a*, 106*b* are deviated from normal insert-pin inserting positions, the insert pin 105 is interfered with by the other row 103 of elements and the box pin 104 when inserting the insert pin 105 into the first and second sliders 106*a*, 106*b*, and there is inconvenience that the insert pin 105 cannot be sufficiently inserted to a predetermined position.

To overcome this inconvenience, according to the slide fastener 101 in Patent Document 1, the suppressing portions 114 are formed on the box pin 104 as described above. With this arrangement, the second slider 106*b* is held at the normal insert-pin inserting position by using frictional force between the suppressing portions 114 and the second slider 106*b*, and a relative position of the second slider 106*b* can be stabilized. At the same time, free sliding of the second slider 106*b* from the normal insert-pin inserting position can be suppressed.

Therefore, even when the person who wears the long coat lifts the box pin 104 and the first and second sliders 106*a*, 106*b* to a position where the insert operation of the insert pin 105 becomes easy by reversing the box pin 104 and the first and second sliders 106*a*, 106*b* before performing the insert operation of the insert pin 105, deviation of the first and second sliders 106*a*, 106*b* from the normal insert-pin inserting positions can be prevented. Accordingly, thereafter, when inserting the insert pin 105 into the first and second sliders 106*a*, 106*b*, the insert operation of the insert pin 105 can be performed smoothly.

Further, in Patent Document 1, a slide fastener 121 as shown in FIG. 17 is disclosed as other embodiment. The slide fastener 121 according to the other embodiment has a ridge portion 122 formed on the front surface and the back surface of the box pin body 111.

The ridge portion 122 is arranged closer to a front end of the box pin than the suppressing portions 114, such that the ridge portion 122 is brought into close contact with the inner surface of the slider body of the first slider 106*a* when the first slider 106*a* moves to the normal insert-pin inserting position where the first slider 106*a* stops at the stopper portion 112. With this arrangement, the first slider 106*a* is held at the normal insert-pin inserting position, and free sliding of the first slider 106*a* from the normal insert-pin inserting position is suppressed.

That is, according to the slide fastener 121 of the other embodiment, the suppressing portions 114 and the ridge portion 122 provided on the box pin 104 can suppress free sliding of the second slider 106*b* and the first slider 106*a* from the normal insert-pin inserting positions, respectively, and can stably hold the position of each slider.

Consequently, even when the person who wears the long coat lifts the box pin 104 and the first and second sliders 106*a*, 106*b* to a position where the insert operation of the insert pin 105 becomes easy by reversing the box pin 104 and the first and second sliders 106*a*, 106*b* before performing the insert operation of the insert pin 105, deviation of the first and second sliders 106*a*, 106*b* from the normal insert-pin inserting positions can be securely prevented. Accordingly, the insert operation of the insert pin 105 can be performed smoothly.

CITED DOCUMENT

Patent Document

Patent Document 1: Japanese Patent Application Laid-Open No. 2009-95425

SUMMARY OF THE INVENTION

Problems to be Solved by the Invention

When the slide fastener 101 in Patent Document 1 as shown in FIG. 16 is used for a long coat or the like, for example, a person who wears the long coat often sequentially slides the first slider 106*a* and the second slider 106*b* to the insert-pin inserting positions of the box pin 104 side in a state that the box pin 104 is lifted by folding back a coattail of the long coat upward, when closing the left and right fastener stringers 102 (when engaging the left and right rows 103 of elements).

In this case, even when the first slider 106*a* is moved to the normal insert-pin inserting position by bringing the first slider 106*a* into contact with the stopper portion 112 of the box pin 104, the first slider 106*a* often moves from the normal insert-pin inserting position to the row 103 of elements, and the position of the first slider 106*a* is deviated due to own weight of the first slider 106*a*, because only the suppressing portions 114 are formed on the box pin 104.

Therefore, thereafter, when the second slider 106*b* is slid until the second slider 106*b* is brought into contact with the first slider 106*a*, the person who wears the long coat misunderstands that the second slider 106*b* moved to the normal insert-pin inserting position because the second slider 106*b* was brought into contact with the first slider 106*a*. However, actually, the position of the first slider 106*a* is deviated from the insert-pin inserting position as described above. Therefore, the second slider 106*b* is also in a state of being slightly deviated from the insert-pin inserting position of the second slider 106*b*.

Particularly, in the case of the slide fastener 101 in Patent Document 1, the suppressing portions 114 of the box pin 104 are formed in a relatively large range of the box pin body 111. Therefore, even when the second slider 106*b* is deviated from the normal insert-pin inserting position, the suppressing portions 114 of the box pin 104 hold the second slider 106*b* at the deviated position. Consequently, thereafter, when inserting the insert pin 105 into the first and second sliders 106*a*, 106*b*, the insert pin 105 cannot be sufficiently inserted to a predetermined position, and the left and right fastener stringers 102 cannot be smoothly closed.

On the other hand, when the slide fastener 121 (see FIG. 17) according to the other embodiment in Patent Document 1 is used for a long coat or the like, the first slider 106*a* can be held at the insert-pin inserting position of the first slider 106*a* by the ridge portion 122 of the box pin 104, when the first slider 106*a* is moved to the normal insert-pin inserting position by bringing the first slider 106*a* into contact with the stopper portion 112 of the box pin 104, in a state that the box pin 104 is lifted by folding back a coattail of the long coat upward.

However, when the person who wears the long coat unconsciously stops the first slider 106*a* before bringing the first slider 106 into contact with the stopper portion 112 of the box pin 104, for example, the first slider 106*a* is held at a position deviated from the normal insert-pin inserting position by the ridge portion 122 of the box pin 104. In this case, the person is not aware that the position of the first slider 106*a* is deviated, and slides the second slider 106*b* toward the first slider 106*a*. The person determines that the second slider 106*b* moved to the normal insert-pin inserting position, based on bringing the second slider 106*b* into contact with the first slider 106*a*.

However, actually, a stop position of the first slider 106*a* is deviated from the insert-pin inserting position as described above. Therefore, the second slider 106*b* is also held by the suppressing portions 114 of the box pin 104 in a state of being slightly deviated from the insert-pin inserting position. Accordingly, thereafter, when inserting the insert pin 105 into the first and second sliders 106*a*, 106*b*, there occurs inconvenience that the insert pin 105 cannot be sufficiently inserted to a predetermined position as described above.

Further, both in the case of the slide fastener 101 shown in FIG. 16 and the slide fastener 121 shown in FIG. 17, when the person unconsciously stops the first and second sliders 106*a*, 106*b* before moving the first and second sliders 106*a*, 106*b* to the normal insert-pin inserting positions when simultaneously moving the first slider 106*a* and the second slider 106*b* in a state that the box pin 104 is lifted by folding back a coattail of the long coat upward, the first and second sliders 106*a*, 106*b* are held at the deviated position by the suppressing portions 114 or by the ridge portion 122.

Therefore, there is a problem that because the person inserts the insert pin 105 into the first and second sliders 106*a*, 106*b* without being aware that positions of the first and second sliders 106*a*, 106*b* are deviated, the person cannot sufficiently insert the insert pin 105 to a predetermined position, and cannot smoothly close the left and right fastener stringers 102.

Further, because the first and second sliders 106*a*, 106*b* are held at positions deviated from predetermined insert-pin inserting positions as described above, the problem that the operation of the insert pin cannot be smoothly performed occurs not only when the left and right fastener stringers 102 are closed but also when the rows 103 of elements are in an engaged state and the left and right fastener stringers 102 are opened.

The invention has been achieved in view of the above conventional problems, and an object of the invention is to provide a slide fastener capable of holding first and second sliders at each of respective insert-pin inserting position and capable of smoothly performing an insert operation or an extract operation of an insert-pin, when a user directs the first and second sliders to slide to a box-pin-side end position of the box pin in opening and closing left and right fastener stringers.

Means for Solving the Problems

To achieve the above object, the slide fastener provided by the invention is a slide fastener that can perform an open/insert operation, and has the most important characteristics described below. The slide fastener includes, as a basic configuration, a pair of first and second fastener stringers having rows of elements at opposite tape-side edge portions of left and right fastener tapes, a box pin extended from an end of the row of elements of the first fastener stringer, an insert pin extended from an end of the row of elements of the second fastener stringer, and a pair of first and second sliders slidably arranged along the rows of elements. The first slider is arranged closer to the box pin than to the second slider in a direction to which rear openings of the first and second sliders face each other. The box pin has a box pin body fixed to the fastener tapes, a stopper portion arranged at a front end side of the box pin body and for stopping the first slider, and a ridge portion formed on at least one of upper and lower surfaces of the box pin body and in close contact with an inner surface of a slider body of the first slider. A chamfered portion for gradually reducing a plate thickness of an upper wing plate or a lower wing plate is formed on an inner surface of at least one of the upper and lower wing plates held by the first slider. The ridge portion is arranged at a position in close contact with the chamfered portion of the first slider when the first slider is stopped at the stopper portion.

In the slide fastener according to the invention, the ridge portion preferably has a crest portion having a largest height of projection from an upper surface or a lower surface of the box pin body, and an inclined portion or a curved portion gradually reducing the projection height from the crest portion toward an element-row-side base end portion of the box pin body or toward a front end portion of the box pin.

In the slide fastener according to the invention, the ridge portion is formed preferably in a tape width direction of the box pin body.

Further, preferably, at least one slit that permits elastic deformation of the ridge portion in a vertical direction is formed in the box pin body.

Effect of the Invention

In the slide fastener according to the invention, a chamfered portion gradually reducing a plate thickness of an upper wing plate or a lower wing plate toward a rear opening is formed on at least one inner surface of the upper and lower wing plates of a first slider (a lower slider, in general) arranged at a box pin side. The box pin has a box pin body, a stopper portion arranged at a front end side of the box pin body, and a ridge portion formed on at least one of upper and lower surfaces of the box pin body and in close contact with an inner surface of a slider body of the first slider. The ridge portion is arranged at a position in close contact with the chamfered portion of the first slider when the first slider is stopped at the stopper portion.

According to the slide fastener of the invention having the above configuration, when the first slider is slid to a box-pin-side end position where the first slider is stopped at the stopper portion of the box pin, the ridge portion of the box pin can first relatively enter an element guiding path of the first slider from a shoulder opening. Further, the ridge portion relatively moves toward a rear opening side by sliding on a plane portion of an inner surface of the upper wing plate or an inner surface of the lower wing plate of the first slider, and reaches the chamfered portion of the first slider when or immediately before the first slider is stopped at the stopper portion.

In this case, when the ridge portion slides on the plane portion of the inner surface of the upper wing plate or the inner surface of the lower wing plate, the ridge portion is pressed against the inner surface of the upper wing plate or the inner surface of the lower wing plate. Therefore, frictional force between the ridge portion and the upper wing plate or the lower wing plate increases, and resistance is given to sliding the first slider.

Thereafter, when the ridge portion moves from the plane portion of the inner surface of the upper wing plate or the inner surface of the lower wing plate to the chamfered portion, the ridge portion is accommodated in a space portion formed by the chamfered portion. In this case, the frictional force between the ridge portion and the upper wing plate or the lower wing plate momentarily reduces. Therefore, it becomes possible to give a change to a contact feeling of a slide operation of the first slider. For example, it becomes possible to give a contact feeling of "click" when the ridge portion moves from the plane portion to the chamfered portion.

That is, according to the slide fastener of the invention, when a user slides the first slider to the normal insert-pin inserting position, it becomes possible to make the user to confirm that the first slider securely moved to the insert-pin inserting position by the contact feeling that the ridge portion relatively moved from the plane portion of the upper wing plate or the lower wing plate to the chamfered portion.

As described above, according to the invention, a measure that makes a user to feel that the first slider moved to the normal insert-pin inserting position is provided. Therefore, it becomes possible to cause the user of the slide fastener to be accustomed to securely slide the first slider to the normal insert-pin inserting position when opening and closing the left and right fastener stringers, and cause the user to confirm that the first slider is securely slid to the normal insert-pin inserting position.

Further, according to the slide fastener of the invention, when the ridge portion is in close contact with the chamfered portion of the first slider, the ridge portion becomes in a state of being pressed against the inclined surface or the curved surface of the chamfered portion.

Therefore, a certain level of frictional force works between the first slider and the ridge portion, and sliding of the first slider is suppressed. Further, in this case, pressing force of the ridge portion applied to the first slider toward the stopper portion of the box pin relatively works by using the inclined surface or the curved surface of the chamfered portion. Consequently, a state that the first slider is in contact with the stopper portion at the insert-pin inserting position can be stably maintained.

As described above, according to the slide fastener of the invention, when opening and closing the left and right fastener stringers, the first slider can be securely slid to the normal insert-pin inserting position, and can be stably held at this position. Therefore, the insert operation and the extract operation of the insert pin can be smoothly performed. Consequently, occurrence of conventional inconvenience attributable to deviation of the slide position of the slider from the normal insert-pin inserting position can be prevented.

Further, according to the slide fastener of the invention, the ridge portion can be configured to include a crest portion having a largest height of projection from an upper surface or a lower surface of the box pin body, and an inclined portion or a curved portion gradually reducing the projection height from the crest portion toward a base end portion of the row of elements of the box pin body or toward a front end portion of the box pin.

By providing the above configuration, when the first slider is slid to the insert-pin inserting position, for example, interference of the ridge portion with the upper and lower wing plates of the first slider can be suppressed, and the first slider can be smoothly slid, when entering the ridge portion from the shoulder opening of the first slider into the element guiding path.

On the other hand, when the first slider held at the insert-pin inserting position is slid to the row of elements to reversely open the left and right fastener stringers, for example, the ridge portion held on the chamfered portion of the first slider can be smoothly slid by smoothly moving the ridge portion on the plane portion of the first slider.

Further, according to the slide fastener of the invention, the ridge portion is formed in a tape width direction of the box pin body. With this arrangement, when sliding the first slider to the insert-pin inserting position, the above feeling can be securely generated in the operation of the first slider. Further, when the first slider is held by the box pin at the inert-pin inserting position, inclination of posture of the first slider to left and right can be prevented, and a direction of the first slider can be arranged.

Further, according to the invention, at least one slit for allowing elastic deformation of the ridge portion in a vertical direction can be formed in the box pin body. By providing this configuration, when the first slier is slid to the insert-pin inserting position, for example, the ridge portion enters the element guide path from the shoulder opening of the first slider as described above.

At this time, because the slit is formed, the ridge portion can be easily elastically deformed in a direction to press the ridge portion against the fastener tapes. Therefore, interference of the ridge portion with the first slider can be prevented, and the ridge portion can be smoothly entered into the element guiding path.

Thereafter, when the ridge portion reaches the chamfered portion of the first slider, the ridge portion recovers elasticity, and the ridge portion can be elastically entered into the space portion formed by the chamfered portion. When sliding the first slider held at the insert-pin inserting position to the row of elements, for example, the ridge portion held by the chamfered portion of the first slider can be easily elastically deformed, and can be smoothly moved on the plane portion of the first slider.

BEST MODES FOR CARRYING OUT THE INVENTION

Embodiments of the invention are explained in detail with the specific examples with reference to drawings. The invention is not limited to embodiments explained below, and various modifications are possible when the modified embodiments have substantially the same configurations and also have similar work effects.

For example, the following embodiments are explained for a case where a box pin is arranged at a rear end side of a right fastener stringer, and an insert pin is arranged at a rear end side of a left fastener stringer. However, the invention is not limited to this case, and can be similarly applied to a case where an insert pin is arranged on the right fastener stringer, a box pin is arranged on the left fastener stringer, and a box pin and an insert pin are arranged at a front end side of the fastener stringer.

First Embodiment

Figure 1:
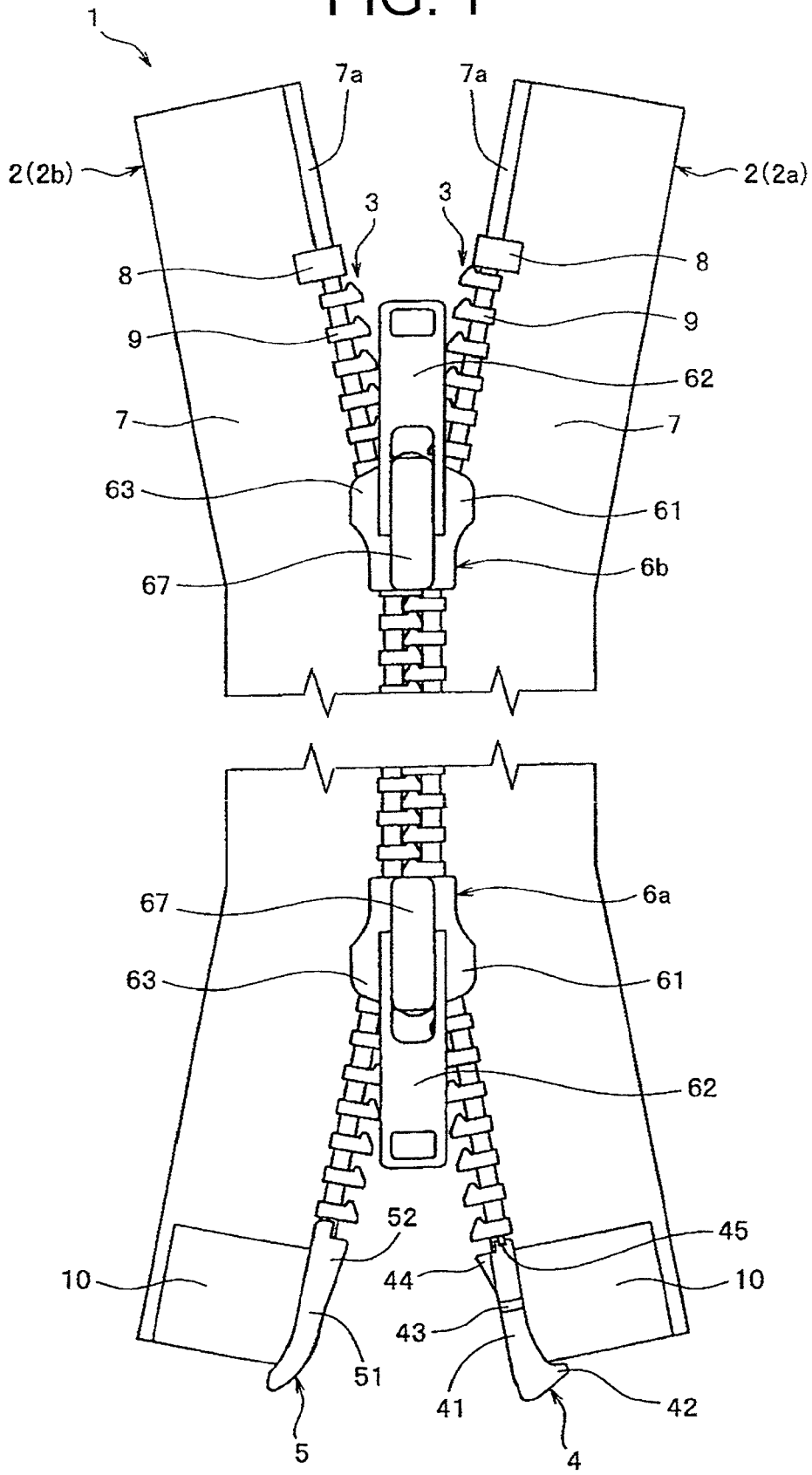
FIG. 1 is a partly-omitted front view of a slide fastener according to a first embodiment of the invention.
Figure 2:
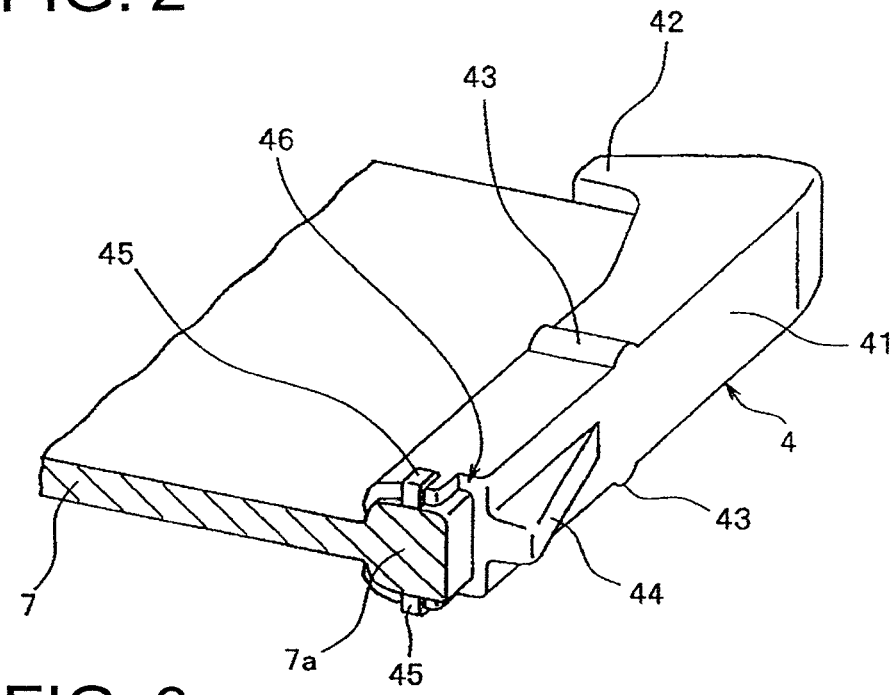
FIG. 2 is a perspective view of a box pin according to the first embodiment.
Figure 3:
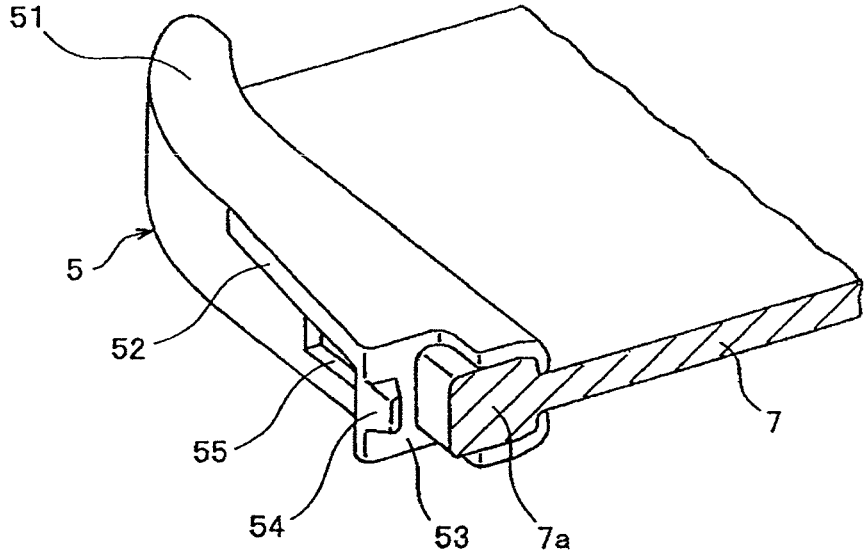
FIG. 3 is a perspective view of an insert pin according to the first embodiment.

FIG. 1 is a partly-omitted front view of a slide fastener according to a first embodiment. FIG. 2 is a perspective view of a box pin held by the slide fastener. FIG. 3 is a perspective view of an insert pin held by the slide fastener.

In the following explanation, a longitudinal direction indicates a longer direction of a fastener tape of a slide fastener. A side where a stopper 8 is arranged on a row 3 of elements is a front side, and a side where a box pin 4 and an insert pin 5 are arranged is a rear side. A horizontal direction indicates a tape width direction of a fastener tape. When the slide fastener is looked at from the front (a surface side), a left side is to the left and a right side is to the right respectively. A vertical direction indicates a front-to-back direction of a tape orthogonal with a tape surface of a fastener tape. A side where an upper wing plate of a slider is arranged is an upper side, and a side where a lower wing plate of the slider is arranged is a lower side, relative to a fastener tape.

A slide fastener 1 according to the first embodiment includes a pair of left and right fastener stringers 2 on which rows 3 of elements are arranged, a box pin 4 provided continuously from an end of the row 3 of elements of a right fastener stringer 2*a* (a first fastener stringer), an insert pin 5 provided continuously from an end of the row 3 of elements of a left fastener stringer 2*b* (a second fastener stringer), and a pair of first and second sliders 6*a*, 6*b* slidably arranged along the rows 3 of elements.

The first slider 6*a* is a reverse-opening slider (which is called a lower slider) arranged at a box pin 4 side, and the second slider 6*b* is a slider (which is called an upper slider) arranged at a stopper 8 side described later.

The left and right fastener stringers 2 have fastener tapes 7, the rows 3 of elements arranged at tape-side edge portions of the fastener tapes 7, and the stoppers 8 fixed to front ends of the rows 3 of elements, respectively. In this case, the left and right fastener tapes 7 have core thread portions 7*a* at opposite tape-side edges of the tapes.

A plurality of fastener elements 9 are attached at a constant interval along the tape-side edge portions of the fastener tapes 7 including the core thread portions 7*a*, and form the rows 3 of elements. Further, reinforcing portions 10 are formed on front and back surfaces of the rear end portions of the fastener tapes 2 by adhering a film made of a resin.

Each of the fastener elements 9 constituting the rows 3 of elements have leg portions fixed to the fastener tapes 7, and coupling heads extended from the leg portions toward outside of the tape. The fastener elements 9 are made of a metal such as a copper alloy and an aluminum alloy, for example, and are formed by fastening a Y-shaped element having a predetermined shape to the fastener tapes 7. In the invention, mode and material of the rows of elements are not particularly limited, and can be arbitrarily changed.

The box pin 4 arranged on the right fastener stringer 2*a* and the insert pin 5 arranged on the left fastener stringer 2*b* are fixed to the fastener tapes 7, by die-cast forming a metal such as a copper alloy and an aluminum alloy or by fastening a part of the box pin 4 and the insert pin 5 made of a metal such as a copper alloy and an aluminum alloy.

In the invention, the box pin 4 and the insert pin 5 can be formed by injection molding a synthetic material such as polyacetal or the like. However, in the invention, because suppressing portions 45 of the box pin 4 are elastically formed as described later, the box pin 4 is preferably formed by metal.

As shown in FIG. 2, the box pin 4 has a box pin body 41 fixed to the tape-side edge portion of the right fastener tape 7 including the core thread portion 7*a*, a stopper portion 42 of a hook shape arranged at the rear end side of the box pin body 41, a ridge portion 43 formed to bulge on an upper surface and a lower surface of the box pin body 41, a first locking piece 44 projected in a triangular shape from a side surface at an insert-pin opposite side of the box pin body 41, and the suppressing portions 45 projected to an upper surface and a lower surface of a front end portion of the box pin body 41.

Figure 4:
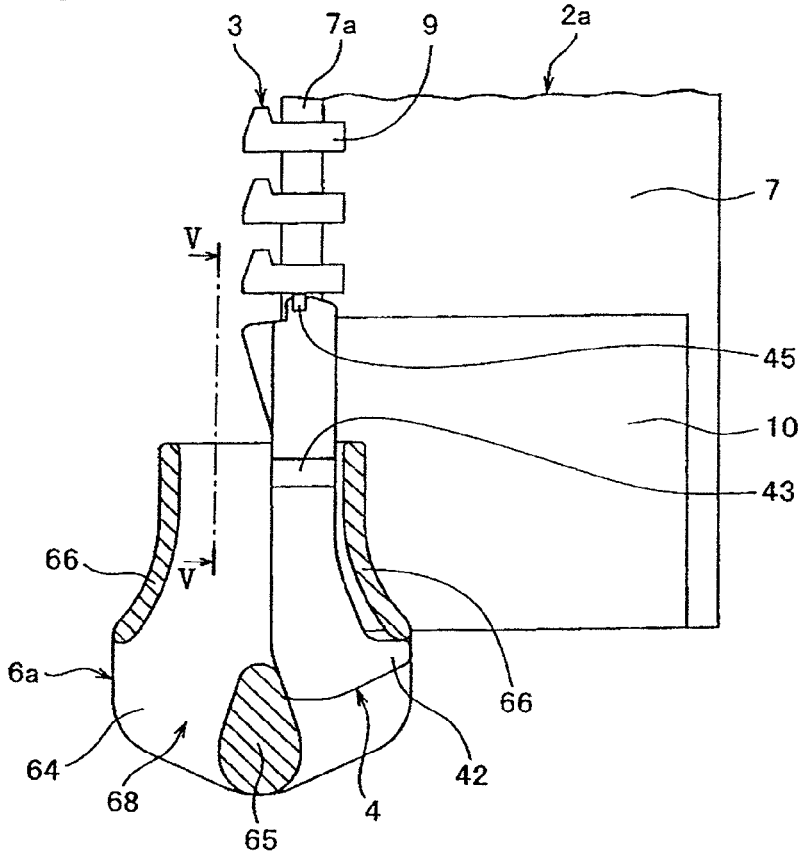
FIG. 4 is an explanatory diagram of a state that a first slider is held at a normal insert-pin inserting position.

The stopper portion 42 of the box pin 4 is formed in a hook shape curved toward inside of the tape from the box pin body 41, and has a function of stopping the first slider 6*a* at the insert-pin inserting position by colliding the row 3 of elements against the first slider 6*a* that slides (see FIG. 4).

The ridge portion 43 of the box pin 4 is formed over a whole of the tape width direction of the box pin body 41. The ridge portion 43 is provided at a position where the ridge portion 43 is brought into close contact with a chamfered portion 69*b* described later of the first slider 6*a*, particularly, at a position where the ridge portion 43 is brought into close contact with a vicinity of a start point of the chamfered portion 69*b* at a plane portion 69*a* side, when the first slider 6*a* stops at the stopper portion 42.

The ridge portion 43 has a crest portion 43*a* having a largest height of projection from upper and lower surfaces of the box pin body 41, and a curved portion 43*b* gradually reducing the height of projection from the crest portion 43*a* toward an element-row-side base end portion of the box pin body 41 and a front end portion of the box pin. The ridge portion has a semicircular shape when looked at in a cross-sectional view along a tape length direction.

In this case, a size from the crest portion 43*a* of the ridge portion 43 formed at an upper surface side of the box pin body 41 to the crest portion 43*a* of the ridge portion 43 formed at a lower-surface side of the box pin body 41 is set larger than a distance between an inner surface of an upper wing plate 63 and an inner surface of a lower wing plate 64 described later of the first slider 6*a*.

A shape of the ridge portion 43 is not particularly limited. The ridge portion 43 can be formed, for example, to have a crest portion, and an inclined portion gradually reducing a height of projection from the crest portion toward the element-row-side base end portion of the box pin body 41 and toward the box-pin front end portion, and can have a triangular shape when looked at in a cross-sectional view along a tape length direction. Alternatively, the ridge portion 43 can be formed to have a rectangular shape when looked at in a cross-sectional view along a tape length direction.

Although the ridge portion 43 according to the first embodiment is provided on the upper and lower surfaces of the box pin body 41, it can be arranged in the invention such that the ridge portion 43 is formed on only the upper surface or on only the lower surface of the box pin body 41. In this case, in the box pin 4, a size in the vertical direction from the crest portion of the ridge portion to a surface of the box pin body where the ridge portion is not formed is set larger than a distance between the inner surface of the upper wing plate 63 and the inner surface of the lower wing plate 64 of the first slider 6*a*.

The first locking piece 44 of the box pin 4 is formed to project from the side surface at the insert-pin opposite side toward the insert pin 5 side, at an intermediate portion in the vertical direction of the box pin body 41, at a front portion side of the box pin body 41. A front end surface parallel with the tape width direction is provided at a front end of the first locking piece 44. A notch portion 46 having a region at a front side of the front end surface of the first locking piece 44 notched is arranged on a side surface portion at the insert-pin opposite side of the box pin body 41, and the core thread portion 7*a* is in an exposed state in the notch portion 46.

The suppressing portions 45 of the box pin 4 are projected on an upper surface portion and a lower surface portion at a front end side of the box pin body 41. In this case, a size from the upper surface of the suppressing portion 45 formed on the upper surface of the box pin body 41 to the lower surface of the suppressing portion 45 formed on the lower surface of the box pin body 41 is set larger than a distance from the inner surface of the upper wing plate 63 and the inner surface of the lower wing plate 64 described later of the second slider 6*b*. The suppressing portions 45 are also extended to the front end surface of the box pin body 41, and are in contact with the fastener element 9 arranged at a nearest side of the box pin 4 of the rows 3 of elements.

The notch portion 46 is provided at the front end of the side surface portion of the box pin body 41 as described above. Therefore, the upper surface portion and the lower surface portion at the front end side of the box pin body 41 on which the suppressing portions 45 are formed are formed to be easily curved in the vertical direction due to elastic deformation.

The insert pin 5 arranged on the left fastener stringer 2*b* includes an insert pin body 51 fixed to a tape-end edge portion of the left fastener tape 7 including the core thread portion 7*a*, a guiding piece 52 extended to a box pin 4 side in parallel with an upper surface of the insert pin body 51, a second locking piece 53 having a plate shape extended from the front end portion of the insert pin body 51 to the box pin 4 side and integrally formed with the front end of the guiding piece 52, and a projecting portion 54 projected to the front surface side of the second locking piece 53 and engaged with the fastener element 9 arranged on the right fastener stringer nearest to the box pin side. On the surface of the insert pin body 51 facing the box pin, there is formed an escape trench 55 to avoid interference of the first locking piece 44 of the box pin 4 with the insert pin body 51 when the insert pin 5 is inserted into the first and second sliders 6*a*, 6*b* as described later.

The first and second sliders 6*a*, 6*b* have a slider body 61 and a tab 62, respectively. The slider body 61 has the upper and lower wing plates 63, 64, a coupling post 65 coupling the upper and lower wing plates 63, 64 with an end portion of the slider, flanges 66 provided at left and right side edges of the upper and lower wing plates 63, 64, and a tab attaching post 67 erected on the front surface of the upper wing plate 63. The tab 62 is rotatably attached to the tab attaching post 67.

Shoulder openings are formed at left and right of an end portion of the slider body 61 where the coupling post 65 is arranged, and a rear opening is formed at an end portion at the opposite side. An approximately Y-shaped element guiding path 68 is provided within the slider body 61 through the left and right shoulder openings and the rear openings.

Further, the plane portion 69*a* that forms a constant plate thickness of the upper and lower wing plates 63, 64, and the chamfered portion 69*b* gradually reducing the plate thicknesses of the upper and lower wing plates 63, 64 toward the rear openings are formed on inner surfaces (wall surfaces at an element guiding path 68 side) of the upper wing plate 63 and the lower wing plate 64. According to the slide fastener 1 of the first embodiment, the first and second sliders 6*a*, 6*b* are arranged such that mutual rear openings face each other.

Next, for the slide fastener 1 of the first embodiment having the above configuration, operation of closing the left and right fastener stringers 2 in a state that the fastener stringers 2 are opened is explained.

First, the first slider 6*a* is slid backward (to the box pin 4 side) along the row 3 of elements of the right fastener stringer 2*a*, and is moved to a position (an insert-pin inserting position) where the shoulder opening side of the first slider 6*a* is brought into contact with the stopper portion 42 of the box pin 4.

At this time, first, the suppressing portions 45 formed at the front end portion of the box pin 4 enter the element guiding path 68 of the first slider 6*a* from the shoulder opening. Further, the suppressing portions 45 pass through the element guiding path 68 and are discharged from the rear opening of the first slider 6*a*.

An upper surface portion and a lower surface portion at the front end side of the box pin body 41 where the suppressing portions 45 are arranged are elastically deformable in the vertical direction as described above. Therefore, the suppressing portions 45 of the box pin 4 can prevent occurrence of inconvenience that the suppressing portions 45 are hung up by being interfered with by the first slider 6*a*, because the upper surface portion and the lower surface portion at the front end side of the box pin body 41 are easily curved to the core thread portions 7*a* when the suppressing portions 45 pass through the element guiding path 68 of the first slider 6*a*.

Next, the ridge portion 43 arranged on the box pin 4 enters the element guiding path 68 of the first slider 6*a* from the shoulder opening. In this case, the ridge portion 43 has a semicircular shape when looked at in a cross-sectional view along the tape length direction, and has the curved portion 43*b* formed in the longitudinal direction from the crest portion 43*a* of the ridge portion 43, as described above. Therefore, the ridge portion 43 can smoothly enter the element guiding path 68 of the first slider 6*a* from the shoulder opening without being hung up by the first slider 6*a*.

When the ridge portion 43 of the box pin 4 is formed to have a triangular shape instead of a semicircular shape like in the present embodiment, the ridge portion 43 can also smoothly enter the element guiding path 68 of the first slider 6*a* from the shoulder opening without being hung up by the first slider 6*a*.

The ridge portion 43 that entered the element guiding path 68 of the first slider 6*a* relatively moves toward the rear opening side of the first slider 6*a* by sliding on the plane portion 69*a* of the inner surface of the upper wing plate and the inner surface of the lower wing plate of the first slider 6*a*. When the ridge portion 43 slides on the plane portion 69*a* of the first slider 6*a* in this way, the ridge portion 43 is being pressed against the upper and lower wing plates 63, 64. Therefore, frictional force between the upper and lower wing plates 63, 64 of the ridge portion 43 increases, and resistance can be given to sliding the first slider 6*a*.

Figure 5:
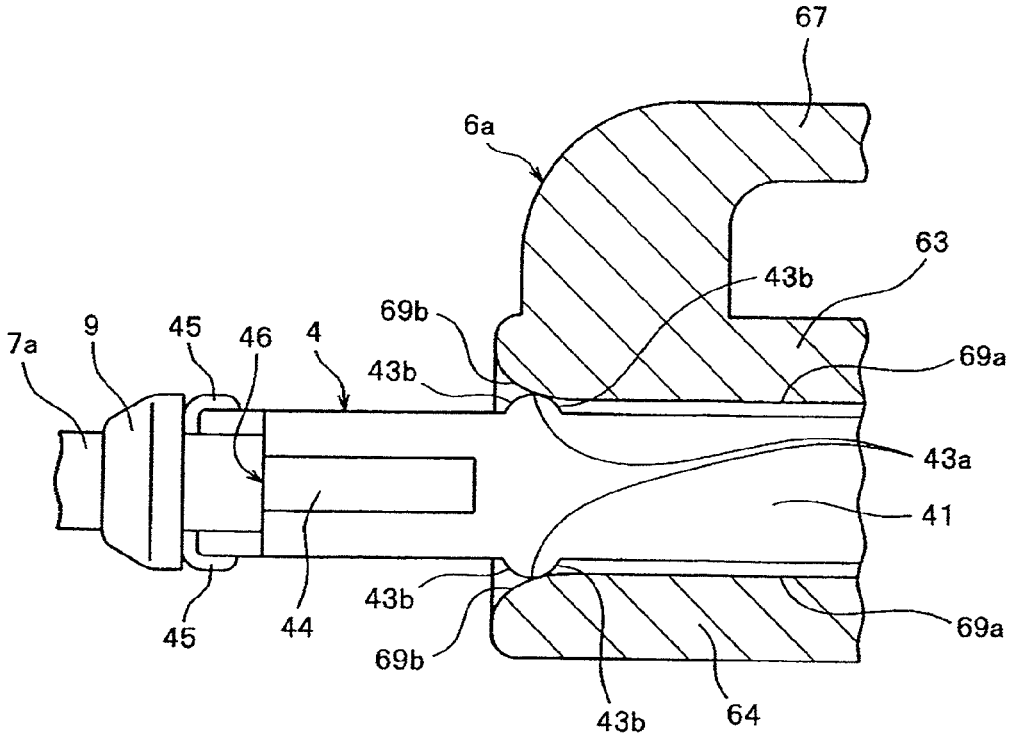
FIG. 5 is a cross-sectional view of the first slider cut along a line V-V with an arrowhead in FIG. 4.

Thereafter, the ridge portion 43 of the box pin 4 reaches the chamfered portion 69*b* from the plane portion 69*a* of the inner surface of the upper wing plate and the inner surface of the lower wing plate when or immediately before the first slider 6*a* stops at the stopper portion 42, and the ridge portion 43 enters a space portion formed by the chamfered portion 69*b* in a state that the ridge portion 43 is in close contact with the chamfered portion 69*b* (see FIGS. 4 and 5).

At this time, because the frictional force between the ridge portion 43 and the upper wing plate 63 momentarily reduces, a change can be given to a contact feeling of a slide operation of the first slider 6*a*. Specifically, it becomes possible to give a contact feeling of "click" to a user who slides the first slider when the ridge portion 43 of the box pin 4 moves from the plane portion 69*a* to the chamfered portion 69*b* of the first slider 6*a*. With this arrangement, the user of the slide fastener 1 can securely confirm that the first slider 6*a* moved to the normal insert-pin inserting position.

As described above, the slide fastener 1 of the first embodiment can cause the user to confirm by feeling that the first slider 6*a* moved to the normal insert-pin inserting position. Therefore, it becomes possible to cause the user to be accustomed to securely slide the first slider 6*a* to the normal insert-pin inserting position when opening and closing the left and right fastener stringers 2.

When the ridge portion 43 of the box pin 4 enters the space portion formed by the chamfered portion 69*b* in a state that the ridge portion 43 is in close contact with the chamfered portion 69*b*, the ridge portion 43 becomes in a state of being pressed against the curved surface of the chamfered portion 69*b*. With this arrangement, frictional force is generated between the ridge portion 43 and the chamfered portion 69*b* of the upper and lower wing plates 63, 64, and sliding of the first slider 6*a* can be suppressed.

Further, because the ridge portion 43 is pressed against the curved surface of the chamfered portion 69*b*, pressing force that the ridge portion 43 applies to the first slider 6*a* backward (toward the stopper portion 42 of the box pin 4) relatively works. Therefore, a state that the first slider 6*a* is in contact with the stopper portion 42 can be stably maintained.

Further, in the first embodiment, because the ridge portion 43 is formed throughout the tape width direction of the box pin body 1, the ridge portion 43 is accommodated in the space portion in close contact with the chamfered portion 69*b*. Therefore, inclination of a posture of the first slider 6*a* to left and right can be prevented when the first slider 6*a* is held, and a direction of the first slider 6*a* can be aligned straight in the longitudinal direction.

Next, after the first slider 6*a* is held at the insert-pin inserting position, the second slider 6*b* is slid backward (to the box pin 4 side), and the second slider 6*b* is stopped at the insert-pin inserting position by bringing the second slider 6*b* into contact with the rear-opening-side end portion of the first slider 6*a*. At this time, the suppressing portions 45 arranged on the box pin 4 enter the element guiding path 68 from the rear opening of the second slider 6*b*. In this case, the upper surface portion and the lower surface portion at the front end side of the box pin body 41 are elastically deformed, and inconvenience that the suppressing portions are hung up by being interfered with by the second slider 6*b* can be prevented.

Figure 6:
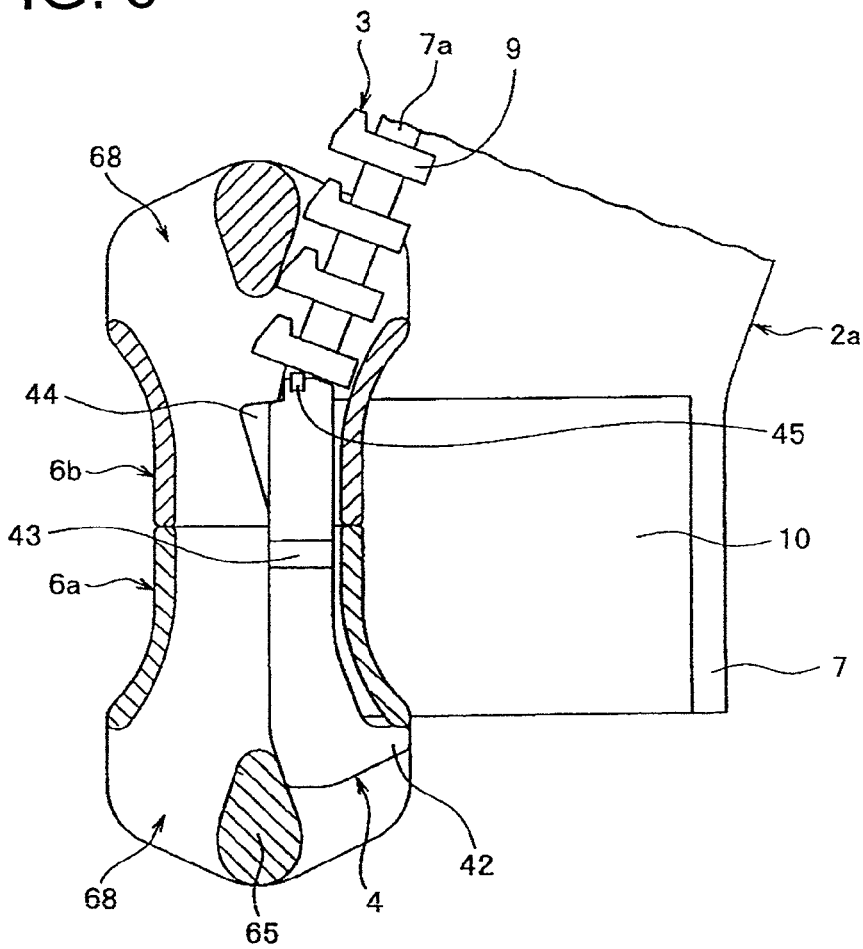
FIG. 6 is an explanatory diagram of a state that first and second sliders are held at normal insert-pin inserting positions.
Figure 7:
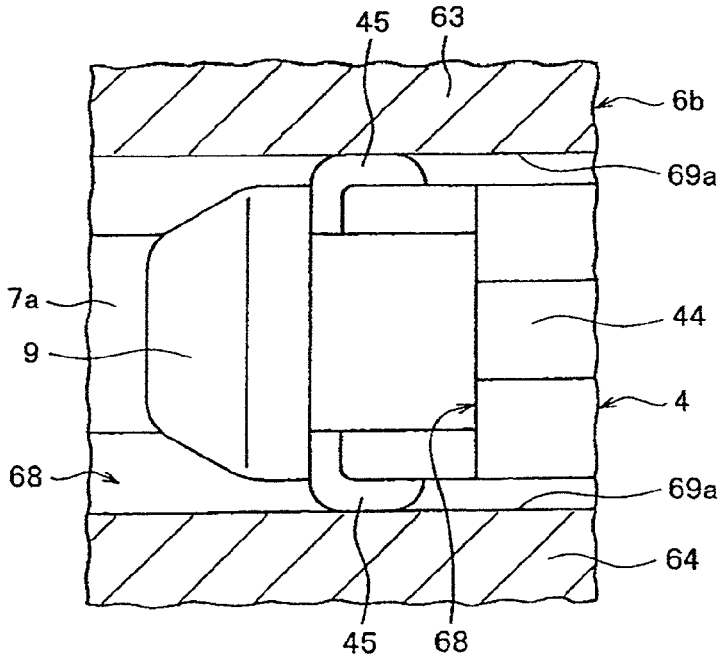
FIG. 7 is an enlarged cross-sectional view of a suppressing portion when the second slider is held at the normal insert-pin inserting position.

After the second slider 6*b* enters the element guiding path 68, the suppressing portions 45 are brought into close contact with the inner surface of the upper wing plate and the inner surface of the lower wing plate of the second slider 6*b* by being pressed against these inner surfaces (see FIGS. 6 and 7). With this arrangement, frictional force between the second slider 6*b* and the suppressing portions 45 increases. Therefore, when the second slider 6*b* stops at the insert-pin inserting position being brought into contact with the first slider 6*a*, the second slider 6*b* can be stably held at the insert-pin inserting position.

Figure 8:
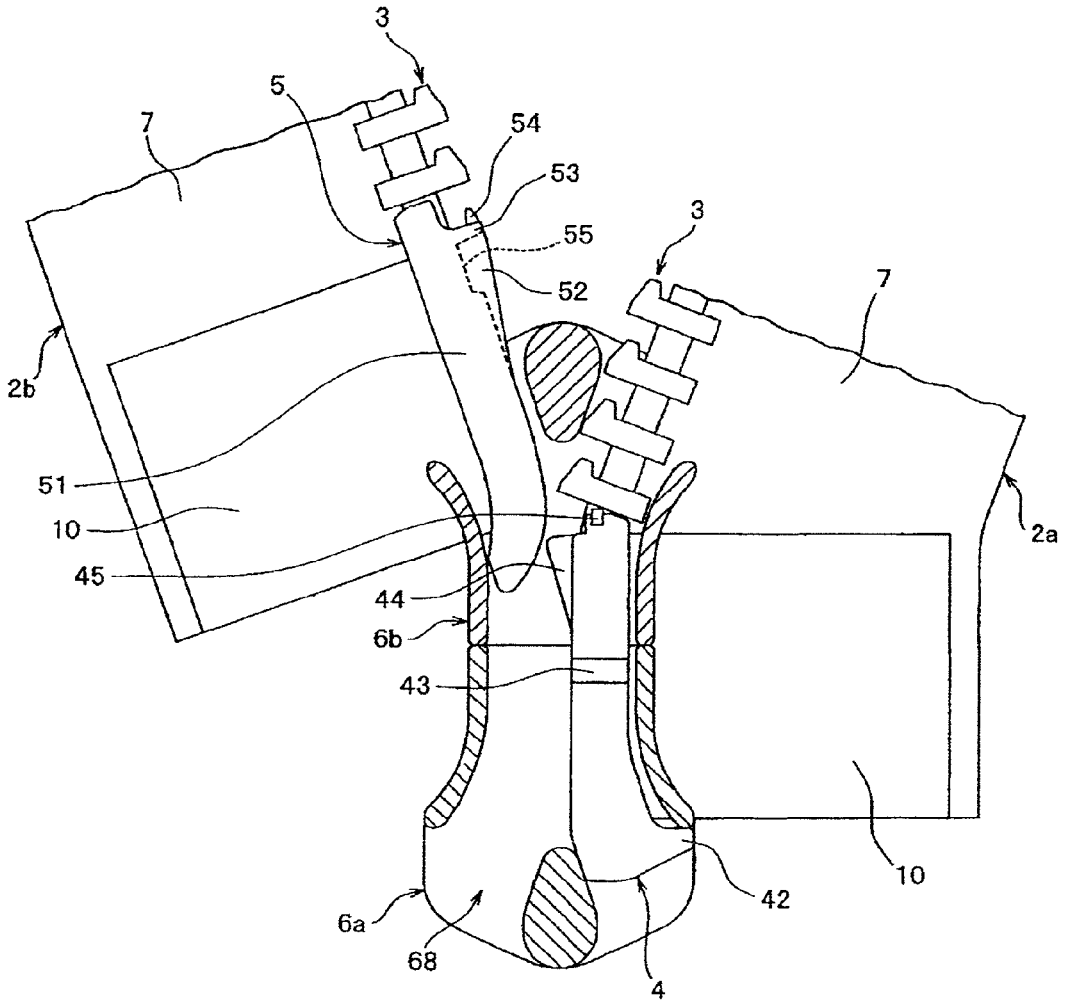
FIG. 8 is an explanatory diagram of operation of inserting the insert pin into the first and second sliders.

As shown in FIG. 8, the insert pin 5 is inserted into the element guiding path 68 of the second slider 6*b* and the element guiding path 68 of the first slider 6*a* from the shoulder opening of the second slider 6*b*. At this time, the first and second sliders 6*a*, 6*b* are stably held at the normal insert-pin inserting positions as described above.

Figure 9:
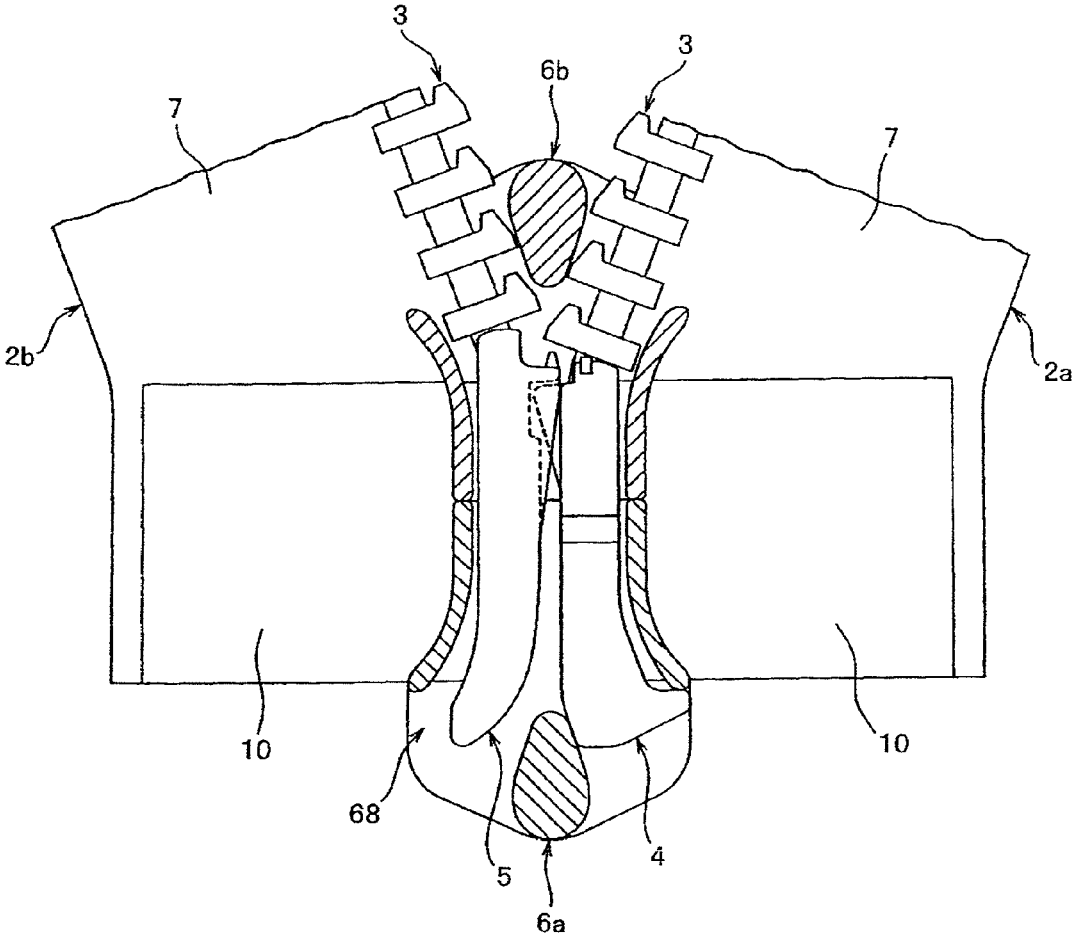
FIG. 9 is an explanatory diagram showing a state that the insert pin is inserted into the first and second sliders.

Therefore, the insert pin 5 can be smoothly and stably inserted to a position where the second locking piece 53 of the insert pin 5 is brought into contact with the first locking piece 44 of the box pin 4 without being stuck up by the row 3 of elements of the right fastener stringer 2*a* and the box pin 4 in the middle (see FIG. 9).

Figure 10:
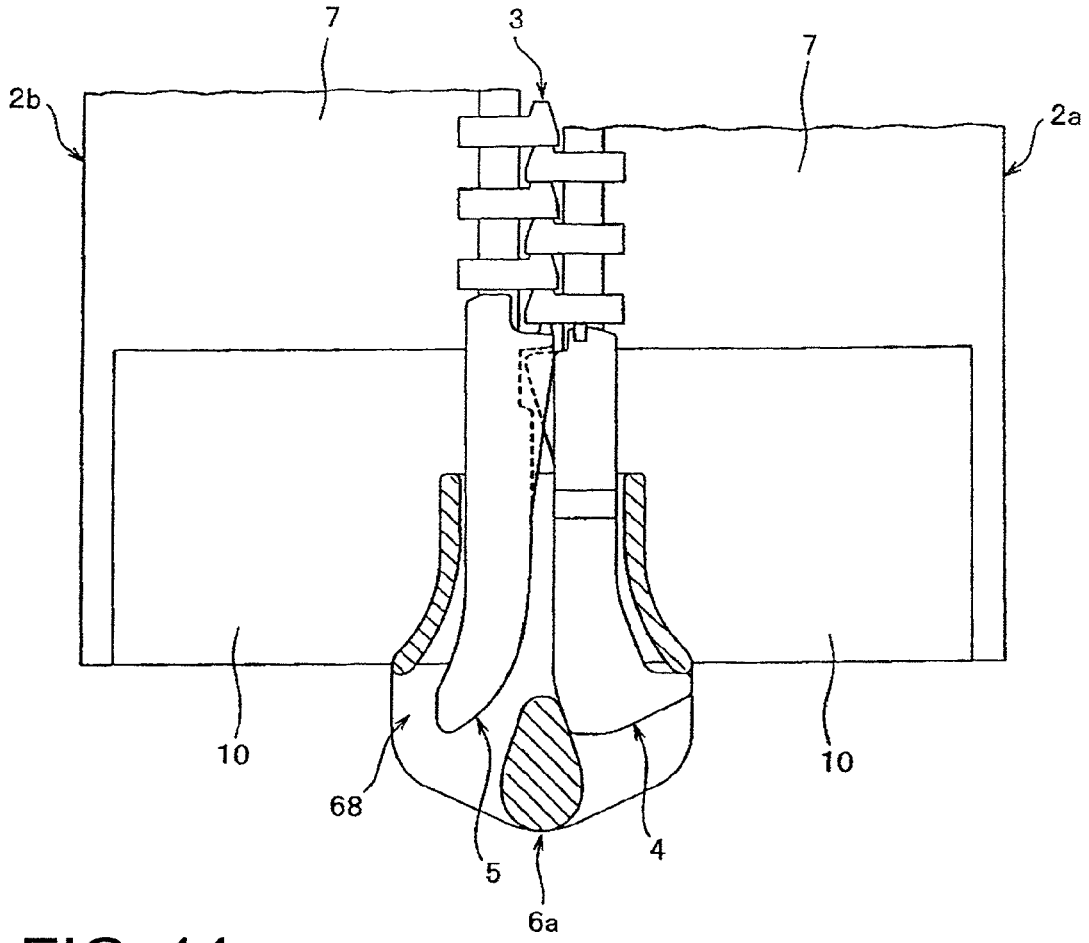
FIG. 10 is an explanatory diagram showing a state that left and right rows of elements are engaged together by sliding the second slider forward.

Thereafter, the second slider 6*b* is slid forward along the row 3 of elements from a state of FIG. 9. As a result, the left and right rows 3 of elements can be engaged, and the left fastener stringer 2*b* and the right fastener stringer 2*a* can be smoothly and stably closed together (see FIG. 10).

Further, thereafter, the first slider 6*a* held at the insert-pin inserting position (the end position at the box pin 4 side) is slid forward along the row 3 of elements. As a result, the left fastener stringer 2*b* and the right fastener stringer 2*a* that are closed together can be easily opened from the end portion (the rear end portion) of the box pin 4 and the inert pin 5 as shown in FIG. 1.

Next, a case of opening the left fastener stringer 2*b* and the right fastener stringer 2*a* by completely separating the fastener stringers in a state that the right and left fastener stringers 2*a*, 2*b* are reversely opened as shown in FIG. 1 is explained.

First, the first slider 6*a* is slid backward along the row 3 of elements, and the first slider 6*a* is moved to the insert-pin inserting position where the first slider 6*a* is brought into contact with the stopper portion 42 of the box pin 4 by engaging the left and right rows 3 of elements.

At this time, the suppressing portions 45 of the box pin 4 pass through the element guiding path 68 from the shoulder opening of the first slider 6*a*, and are discharged from the rear opening of the first slider 6*a*, without generating inconvenience that the suppressing portions 45 are stuck up by the first slider 6*a*. Next, the ridge portion 43 of the box pin 4 enters the element guiding path 68 from the shoulder opening of the first slider 6*a*, and relatively moves toward the rear opening side by sliding on the plane portion 69*a* of the inner surface of the upper wing plate 63. Further, the ridge portion 43 reaches the chamfered portion 69*b* from the plane portion 69*a* of the upper and lower wing plates 63, 64, and is brought into close contact with the chamfered portion 69*b* when or immediately before the first slider 6*a* stops at the stopper portion 42.

When the ridge portion 43 reaches the chamfered portion 69*b* of the first slider 6*a*, a contact feeling of "click" can be given to the operation of the first slider 6*a* as described above. Accordingly, the user can securely recognize and confirm that the first slider 6*a* moved to the normal insert-pin inserting position. When the ridge portion 43 of the box pin 4 is brought into close contact with the chamfered portion 69*b*, sliding of the first slider 6*a* can be suppressed, and a state that the first slider 6*a* is in contact with the stopper portion 42 can be stably held.

Next, the second slider 6*b* is slid backward. Accordingly, the left and right rows of elements in the engaged state are separated from each other, and the second slider 6*b* is stopped at a position (the insert-in inserting position) where the second slider 6*b* is brought into contact with the end portion of the rear opening of the first slider 6*a*. At this time, the suppressing portions 45 of the box pin 4 are pressed against the inner surfaces of the upper and lower wing plates 63, 64 of the second slider 6*b*. Therefore, frictional force is generated between the suppressing portions 45 and the upper and lower wing plates 63, 64 of the second slider 6*b*, and the second slider 6*b* can be held at the insert-pin inserting position.

Thereafter, the insert pin 5 is extracted from the element guiding path 68 of the first and second sliders 6*a*, 6*b*. At this time, the first and second sliders 6*a*, 6*b* are held at the respective insert-pin inserting positions. Therefore, the insert pin can be smoothly and stably extracted. Accordingly, the left fastener stringer 2*b* and the right fastener stringer 2*a* can be smoothly and stably opened.

Because the slide fastener 1 according to the first embodiment is configured as described above, when the slide fastener 1 is used for a long coat or the like, a person who wears the long coat or the like can smoothly insert the insert pin 5 as follows, even when the person inserts the insert pin 5 from a lower side of the first and second sliders 6*a*, 6*b* in a state that the first and second sliders 6*a*, 6*b* are lifted to a position where the insert pin 5 can be easily inserted by folding back a coattail of the long coat upward and by reversing a positional relationship between the first and second sliders 6*a* and 6*b* in order to easily insert the insert pin 5 into the first and second sliders 6*a*, 6*b*.

That is, according to the slide fastener 1 of the present embodiment, even when the person behaves as described above, the first slider 6*a* can be slid until when the first slider 6*a* moves to the normal insert-pin inserting position (that is, until when a contact feeling of "click" can be obtained). Therefore, the first slider 6*a* can be stably held in a state of being brought into contact with the stopper portion 42, and a position of the first slider 6*a* can be prevented from being deviated from the insert-pin inserting position due to own weight.

Further, thereafter, when the person slides the second slider 6*b* to a position where the second slider 6*b* is brought into contact with the first slider 6*a*, the second slider 6*b* is stably held at the normal insert-pin inserting position by the suppressing portions 45 of the box pin 4. Therefore, a position of the second slider 6*b* can be prevented from being deviated from the position where the second slider 6*b* is in contact with the first slider 6*a* due to own weight.

Therefore, thereafter, the person can smoothly insert the insert pin 5 into the first and second sliders 6*a*, 6*b*, and can easily close the left and right fastener stingers 2.

Further, according to the fastener stringer 2 of the first embodiment, the extract operation of the insert pin 5 and the insert operation of the insert pin 5 can be smoothly operated, when opening the left and right fastener stringers 2 that are closed, or when simultaneously sliding the first and second sliders 6*a*, 6*b* to the insert-pin inserting positions in opening and closing the left and right fastener stringers 2.

For the slide fastener 1 according to the first embodiment, a case where the suppressing portions 45 are formed on the box pin 4 is explained. However, in the invention, it is sufficient that at least the ridge portion 43 is formed on the box pin 4, and formation of the suppressing portions 45 can be omitted.

Figure 11:
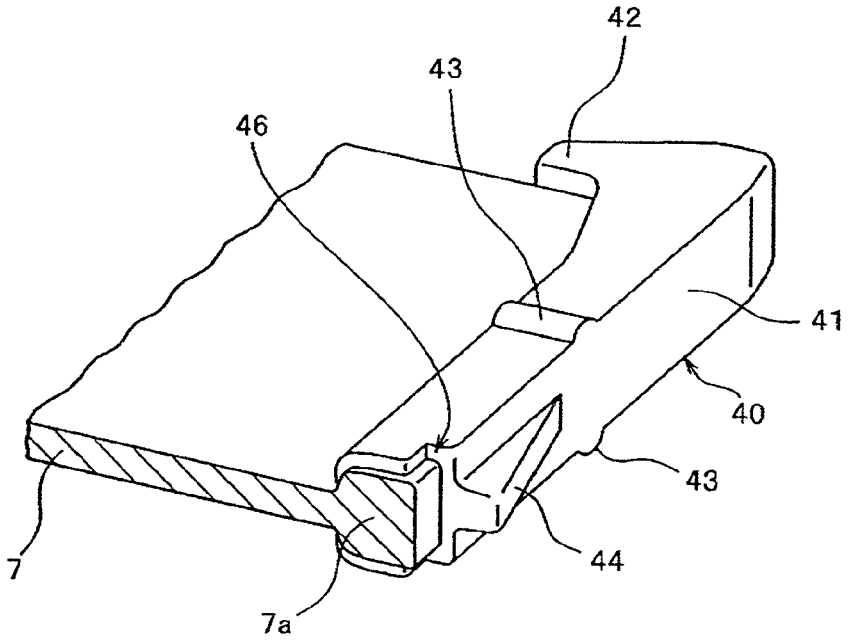
FIG. 11 is a perspective view of a box pin according to a modification of the first embodiment.
Figure 12:
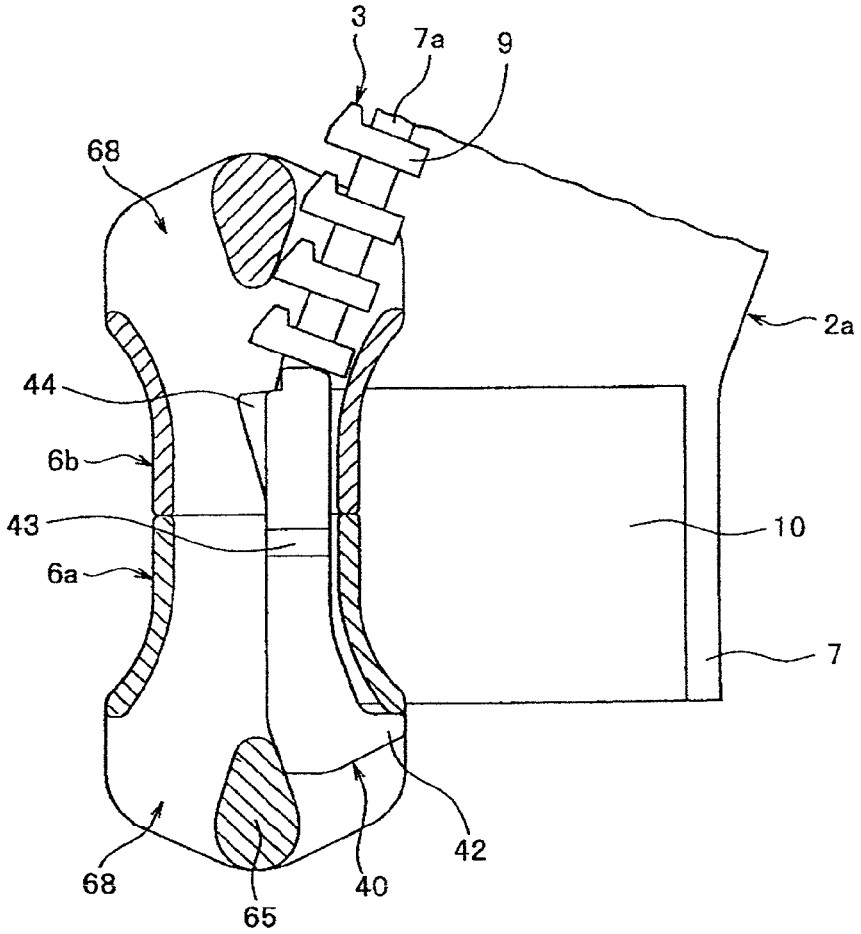
FIG. 12 is an explanatory diagram of a state that first and second sliders are held at normal insert-pin inserting positions according to a modification of the first embodiment.

A modification of the first embodiment is shown in FIGS. 11 and 12, for example. A box pin 40 has the box pin body 41, the stopper portion 42, the ridge portion 43, and the first locking piece 44. The suppressing portions 45 as described above are not formed on the upper surface portion and the lower surface portion at the front side of the box pin body 41.

The slide fastener having this box pin 40 can also give a contact feeling of "click" to a user who performs the slide operation of the first slider 6*a* when the first slider 6*a* moved to the insert-pin inserting position. Therefore, the first slider 6*a* can be stably held at the normal insert-pin inserting position.

In this case, because the suppressing portions 45 are not formed, the box pin 40 cannot hold the second slider 6*b* at the insert-pin inserting position. However, when the user slides the second slider 6*b* to a position (the insert-pin inserting position) where the second slider 6*b* is brought into contact with the first slider 6*a* and then holds the second slider 6*b* together with the first slider 6*a* with the thumb and the first finger from the vertical direction at the insert-pin inserting position, for example, the person thereafter can smoothly insert and extract the insert pin 5.

A mode of not forming the suppressing portions on the box pin can be similarly applied to a second embodiment and third embodiment described later.

Second Embodiment

Figure 13:
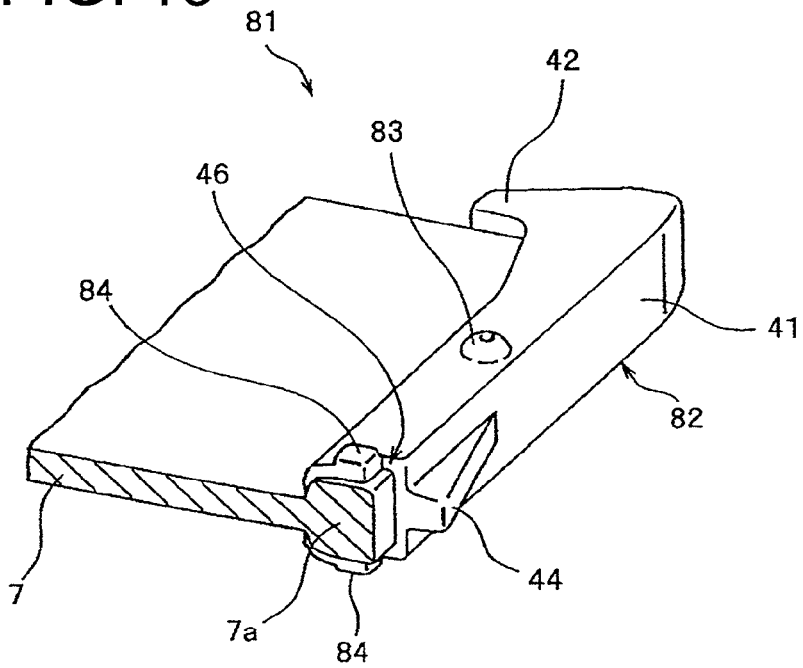
FIG. 13 is a perspective view of a box pin according to a second embodiment.

FIG. 13 is a perspective view of a box pin according to the second embodiment.

According to a slide fastener 81 of the second embodiment, a mode of a ridge portion 83 of a box pin 82 and a mode of suppressing portions 84 are different from those of the ridge portion 43 of the box pin 4 and the suppressing portions 45 of the first embodiment described above.

Configurations of portions other than the ridge portion 83 and the suppressing portions 84 in the second embodiment are basically the same as those of the slide fastener 1 in the first embodiment described above. Therefore, portions of the slide fastener 81 in the second embodiment that have similar configurations to those of members explained in the first embodiment are attached with the same reference numerals and their explanation is omitted.

The ridge portion 83 of the second embodiment is formed in an approximately a conical shape on an upper surface and a lower surface of the box pin body. The ridge portion 83 is provided at a position where the ridge portion 83 is in close contact with the chamfered portion 69*b* of the first slider 6*a* when the first slider 6*a* stops at the stopper portion 42 of the box pin 82. A size from a crest portion of the ridge portion 83 formed at an upper surface side of the box pin body 41 to a crest portion of the ridge portion 83 formed at a lower surface side of the box pin body 41 is set larger than a distance between the inner surface of the upper wing plate 63 and the inner surface of the lower wing plate 64 described later of the first slider 6*a*.

The suppressing portions 84 of the second embodiment are formed on the upper and lower surfaces of the box pin body 41, and are not extended to the front surface of the box pin body 41. A formation area of the suppressing portions 84 on the upper and lower surfaces of the box pin body 41 is set larger than that of the suppressing portions 45 of the first embodiment.

With this arrangement, when the second slider 6*b* stops at the insert-pin inserting position, large frictional force can be generated between the second slider 6*b* and the suppressing portions 84, and the second slider 6*b* can be held more stably at the insert-pin inserting position.

As described above, according to the slide fastener 81 of the second embodiment, formation of the suppressing portions 84 can be omitted.

The slide fastener 81 of the second embodiment can give a contact feeling of "click" to the user who slides the first slider 6*a* when the first slider 6*a* moves to the insert-pin inserting position, in a similar manner to that of the first embodiment, because the ridge portion 83 is provided on the box pin 82. Therefore, it becomes possible to cause the user to be accustomed to securely slide the first slider 6*a* to the insert-pin inserting position when opening and closing the left and right fastener stringers 2. Consequently, the user can smoothly perform a subsequent insert or extract operation of the insert pin 5.

The slide fastener 81 of the second embodiment has the ridge portion 83 formed in approximately a conical shape. Therefore, occurrence of inconvenience that the ridge portion 83 is hung up by being interfered with by the first slider 6*a* can be securely prevented when the ridge portion 83 enters the element guiding path 68 from the shoulder opening of the first slider 6*a* or when the ridge portion 83 moves from the chamfered portion 69*b* of the first slider 6*a* to the plane portion 69*a*.

Further, according to the slide fastener 81 of the second embodiment, presence of the ridge portion 83 can be made not so discreet as compared with the first embodiment. Therefore, external appearance quality of the slide fastener can be improved.

Third Embodiment

Figure 14:
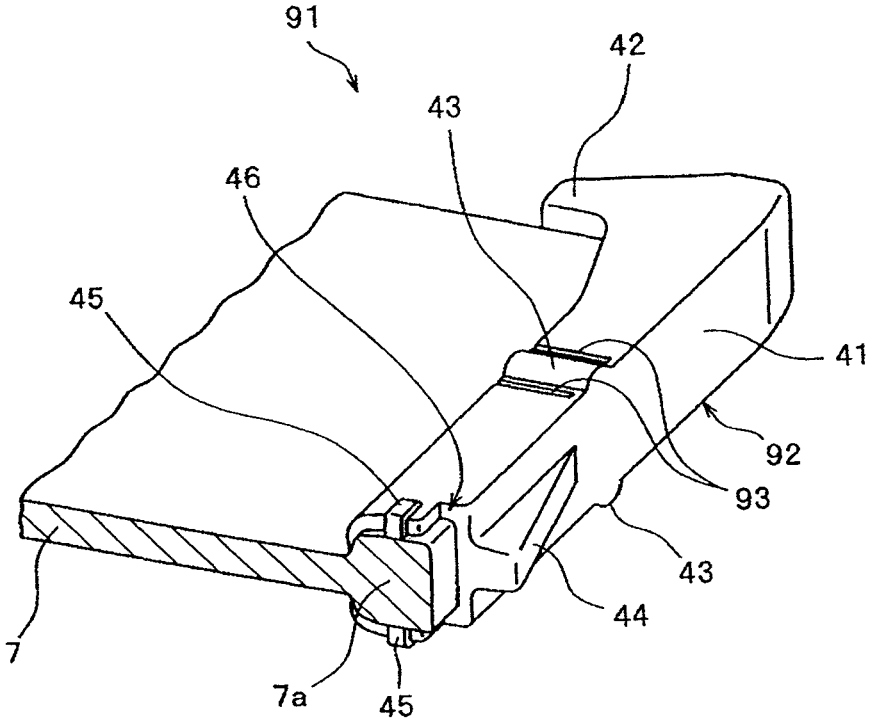
FIG. 14 is a perspective view of a box pin according to a third embodiment.
Figure 15:
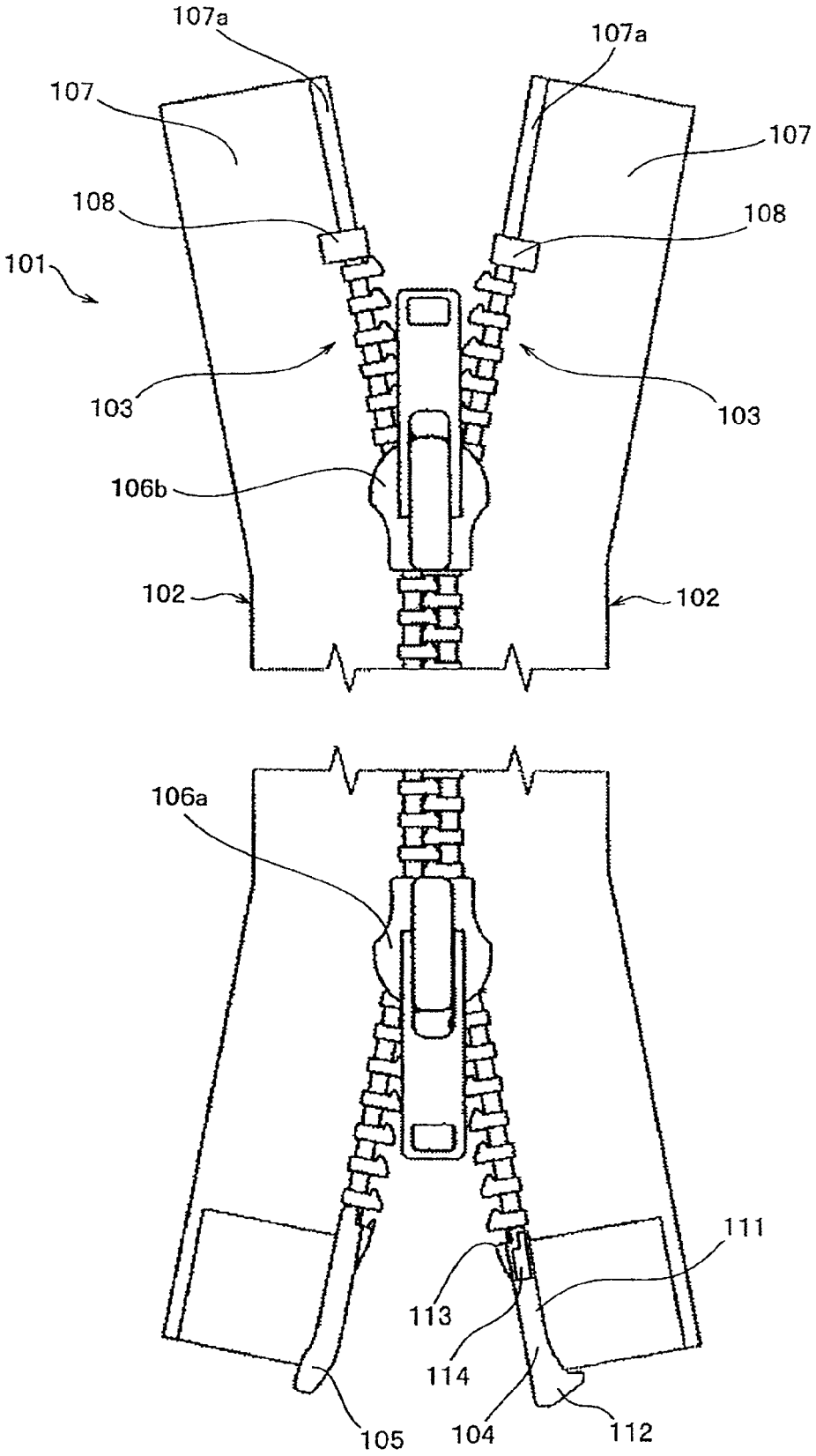
FIG. 15 is a partly-omitted front view of a conventional reverse-opening slide fastener.
Figure 16:
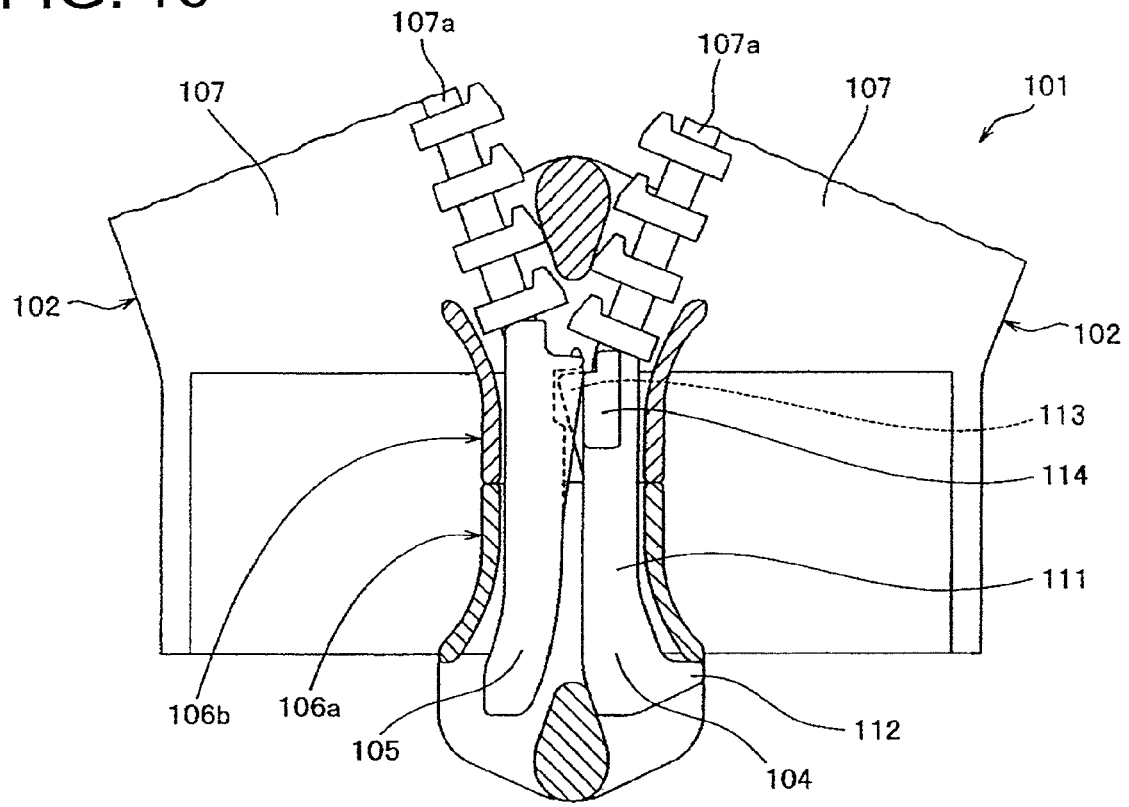
FIG. 16 is a cross-sectional view of a main portion of a conventional slide fastener.
Figure 17:
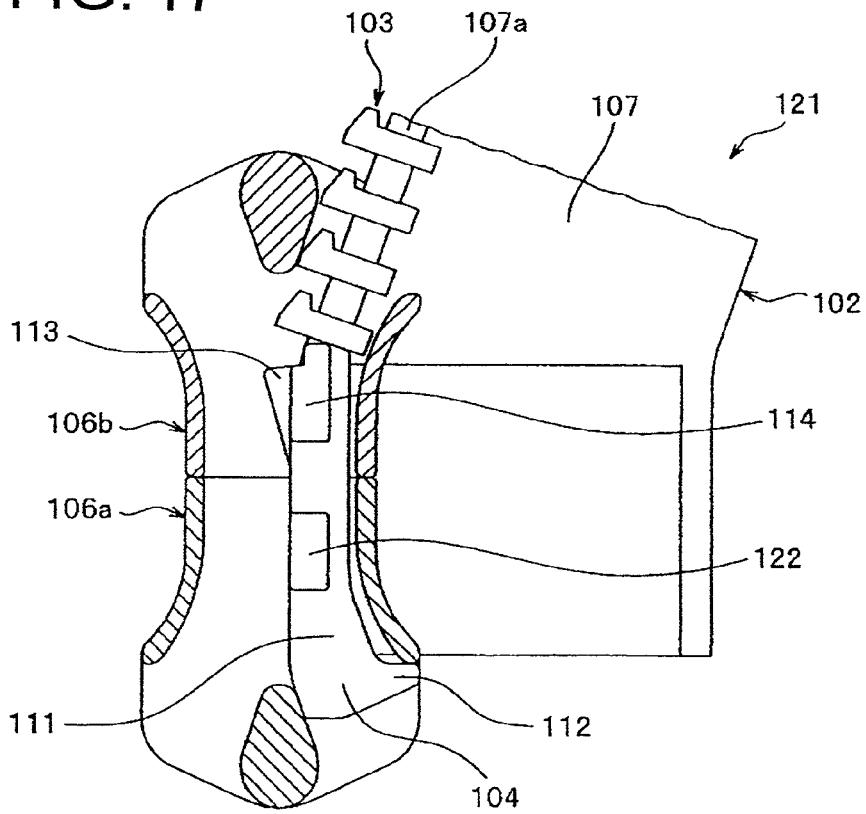
FIG. 17 is a cross-sectional view of a main portion of other conventional slide fastener.

FIG. 14 is a perspective view of a box pin according to a third embodiment.

According to a slide fastener 91 of the third embodiment, a plurality of slits 93 for allowing elastic deformation of the ridge portion 43 in the vertical direction are formed on the box pin body 41 of a box pin 92. Other configurations are basically the same as those of the slide fastener 1 of the first embodiment. Therefore, portions of the slide fastener 91 in the third embodiment that have similar configurations to those of members explained in the first embodiment are attached with the same reference numerals and their explanation is omitted.

Two slits 93 are formed on each of an upper surface and a lower surface of the box pin 92 in the third embodiment. The slits 93 on the upper surface and the lower surface of the box pin 92 are formed by cutting from a tape inner-side side surface of the box pin body 41 at a position ahead of and at a position exterior to the ridge portion 83.

The slide fastener 91 of the third embodiment having the box pin 92 can also give a contact feeling of "click" to a user who slides the first slider 6*a* when the first slider 6*a* moved to the insert-pin inserting position, in a similar manner to that of the first embodiment. Therefore, it becomes possible to cause the user to be accustomed to securely slide the first slider 6*a* to the insert-pin inserting position when opening and closing the left and right fastener stringers 2. Consequently, the user can smoothly perform subsequent insert and extract operations of the insert pin 5.

Further, because the two slits 93 are formed on each of the upper surface and the lower surface of the box pin body 41 in the slide fastener 91 of the third embodiment, when entering the ridge portion 43 in the element guiding path 68 from the shoulder opening of the first slider 6*a*, the ridge portion 43 can be easily elastically deformed at the core thread portion 7*a*, and the ridge portion 43 can be smoothly entered in the element guiding path 68.

EXPLANATION OF REFERENCE NUMERALS

1 Slide fastener
2 Fastener stringer
2*a* Right fastener stringer
2*b* Left fastener stringer
3 Row of elements
4 Box pin
5 Insert pin
6*a* First slider
6*b* Second slider
7 Fastener tape
7*a* Core thread portion
8 Stopper
9 Fastener element
10 Reinforcing portion
40 Box pin
41 Box pin body
42 Stopper portion
43 Ridge portion
43*a* Crest portion
43*b* Curved portion
44 First locking piece
45 Suppressing portion
46 Notch portion
51 Insert pin body
52 Guiding piece
53 Second locking piece
54 Projecting portion
55 Escape trench
61 Slider body
62 Tab
63 Upper wing plate
64 Lower wing plate
65 Coupling post
66 Flange
67 Tab attaching post
68 Element guiding path
69*a* Plane portion
69*b* Chamfered portion
81 Slide fastener
82 Box pin
83 Ridge portion
84 Suppressing portion
91 Slide fastener
92 Box pin
93 Slit

The invention claimed is:

1. A slide fastener capable of performing an open/insert operation, comprising a pair of first and second fastener stringers having rows of elements at opposite tape-side edge portions of left and right fastener tapes, a box pin extended from an end of the row of elements of the first fastener stringer, an insert pin extended from an end of the row of elements of the second fastener stringer, and a pair of first and second sliders slidably arranged along the rows of elements, wherein the first slider is arranged closer to the box pin than the second slider in a direction to which rear openings of the first and second sliders face each other, the box pin has a box pin body fixed to the fastener tapes, a stopper portion arranged at a front end side of the box pin body and for stopping the first slider, and a ridge portion formed on at least one of upper and lower surfaces of the box pin body and in close contact with an inner surface of a slider body of the first slider, a chamfered portion gradually reducing a plate thickness of an upper wing plate or a lower wing plate is formed on an inner surface of at least one of the upper and lower wing plates held by the first slider, and the ridge portion is arranged at a position in close contact with the chamfered portion of the first slider when the first slider is stopped at the stopper portion.

2. The slide fastener according to claim 1, wherein the ridge portion has a crest portion having a largest height of projection from an upper surface or a lower surface of the box pin body, and an inclined portion or a curved portion for gradually reducing the projection height from the crest portion toward an element-row-side base end portion of the box pin body or toward a front end portion of the box pin.

3. The slide fastener according to claim 1, wherein the ridge portion is formed in a tape width direction of the box pin body.

4. The slide fastener according to claim 1, wherein at least one slit that permits elastic deformation of the ridge portion in a vertical direction is formed in the box pin body.

* * * * *